US006116423A

United States Patent [19]

Troxtell, Jr. et al.

[11] Patent Number: 6,116,423

[45] Date of Patent: Sep. 12, 2000

[54] MULTI-FUNCTIONAL SHIPPING SYSTEM FOR INTEGRATED CIRCUIT DEVICES

[75] Inventors: Clessie A. Troxtell, Jr., Howe; Laura A. Hnilo, McKinney; Michael L. Hayden, Plano; Charles M. Hess, Dallas; Daniel R. Wikander, Richardson; Lee A. Lewis, Murphy, all of Tex.

[73] Assignee: Texas Instruments Incorporated, Dallas, Tex.

[21] Appl. No.: 09/359,524

[22] Filed: Jul. 23, 1999

[51] Int. Cl.[7] ..... B65D 85/90

[52] U.S. Cl. ..... 206/523; 53/420; 206/594; 206/713; 206/723; 414/810

[58] Field of Search ..... 206/523, 591, 206/594, 706, 709, 713, 721, 723, 737; 229/123; 53/410, 420; 414/810, 811; 493/84, 89, 94, 100

[56] References Cited

U.S. PATENT DOCUMENTS

| | | | |
|---|---|---|---|
| 4,241,829 | 12/1980 | Hardy | 206/523 |
| 4,295,599 | 10/1981 | Locatelli et al. | 206/737 |
| 4,712,674 | 12/1987 | Young | 206/723 |
| 4,966,280 | 10/1990 | Bradford | 206/723 |
| 5,366,080 | 11/1994 | Carstersen et al. | 206/523 |
| 5,477,966 | 12/1995 | Ogawa et al. | 206/723 |
| 5,706,951 | 1/1998 | Oinuma et al. | 206/721 |

*Primary Examiner*—Jim Foster
*Attorney, Agent, or Firm*—Gary C. Honeycutt; Fred Telecky

[57] ABSTRACT

A multifunctional shipping container for integrated circuits, and methods of using and reusing the container are described. The compact container coupled with foam inserts is dimensioned to securely ship and store integrated circuits in either tray or reel format. The container with an expandable cavity allows ease of access for loading and unloading the contents at multiple work stations, and may be converted to an in-house "tote". Multifunctionality of the container supports use as a shipping system from the tray or reel supplier, to the IC assembly and test site, to distribution centers, and to the IC customer, thus eliminating multiple costs of disposal, inventory and new shipping materials.

19 Claims, 7 Drawing Sheets

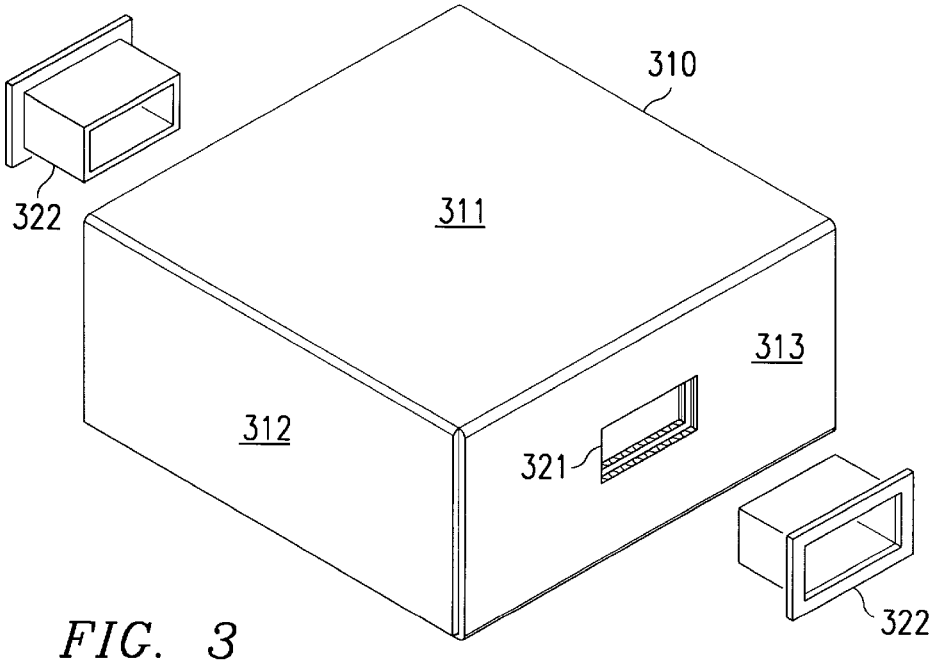
FIG. 3
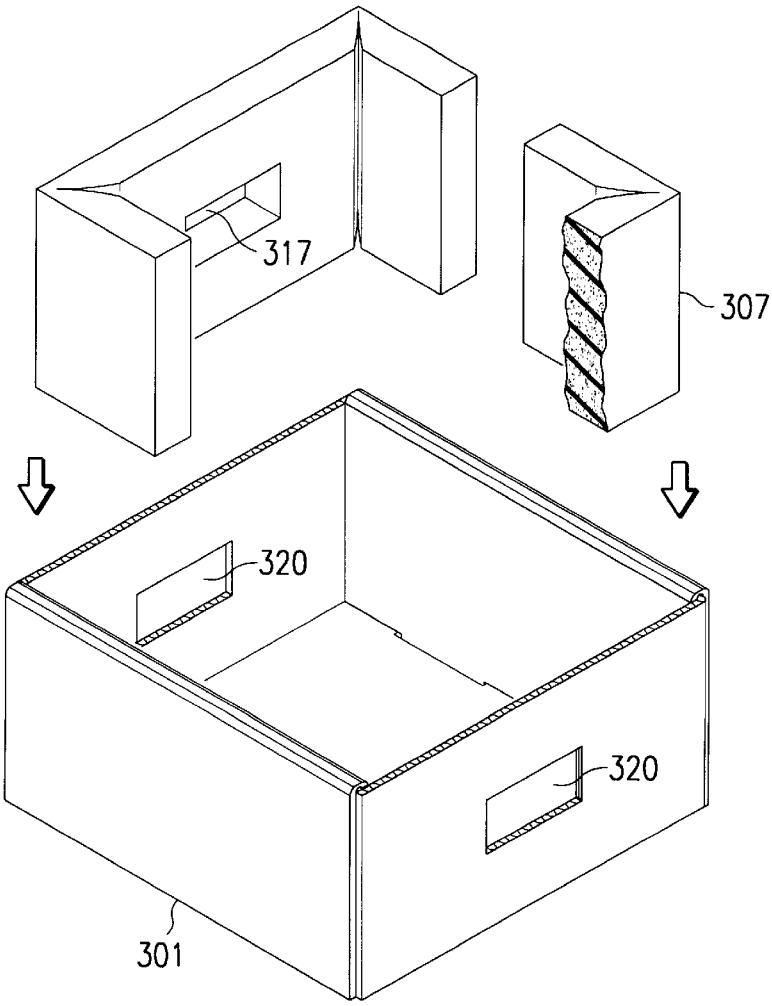

MULTI-FUNCTIONAL SHIPPING SYSTEM FOR INTEGRATED CIRCUIT DEVICES

FIELD OF THE INVENTION

The present invention relates generally to a shipping container and more specifically a multifunctional container for transporting integrated circuit devices, and methods for using the container.

BRIEF DESCRIPTION OF RELATED ART

Integrated circuit devices require a means for protective handling and transporting of the finished parts in order to avoid mechanical damage to the lead tips, the lead finishes, or assembled packages, as well as to provide environmental protection from moisture and from static charges. Further, the integrated circuit (IC) devices must be transported in carriers that are compatible with the customer's in-house equipment system. For these reasons, the primary carriers for integrated circuit devices, such as plastic trays with an array of recesses, or tape and reel carriers have received considerable attention from worldwide committees, and have been standardized so that the using customer is not subjected to variations from different suppliers. Leaded surface mount devices, as well as more advanced area array packaged devices are transported in tape and reel format, or in plastic trays. These primary carriers are packed in moisture or static shielding bags after final testing of the circuits, prior to placing in a shipping container. FIG. 1*a* illustrates a tape and reel carrier in which integrated circuit packaged devices 101 are held in a series of in-line recesses 102 in a carrier tape 103. The upper surface of the carrier tape is heat sealed by a cover tape 104 to hold the devices in place. The tape is wound onto a reel 105, and the loaded reel is sealed in a moisture-proofing bag (not shown). The width of the tape is governed by size of IC packages. The reel diameter is kept constant for compatibility with equipment at both the user and supplier.

Similarly, plastic trays for holding integrated circuit devices are kept with the same dimensions, but the number of recesses for ICs is varied according to IC package size. In FIG. 1*b*, an example of a tray for carrying surface mount integrated circuits is illustrated. The tray 110 is typically made of a static dissipative or antistatic polymeric material, and the IC devices 111 are placed into an array of square or rectangular recesses 112 whose dimensions are set for a family of device sizes. For storage and shipment, a series of trays are stacked and the top most filled tray covered by an empty tray. The stacked trays are banded together to minimize movement of the devices. A stack of trays is then sealed in a moisture or static shielding bag.

However, containers for shipping the primary carriers have received much less attention, and the result is that both an environmentally and economically wasteful one-time use of boxes, padding and other packing materials is made at each work step. One set of materials is used to transport empty trays or reels from the manufacturer to the IC package assembly site, that set of materials is disposed of, and another one-time set of materials is used after filling the primary carriers with ICs. Another set of shipping materials is used if testing is done at a remote location, and often additional packaging materials are added at a product distribution site. Finally the shipping and packing materials are disposed of by the customer after removing the IC devices from the carriers. If the trays and/or reels are to be returned, another set of packing materials is needed. Each step requires disposal of the material, labor and materials for new containers and shipping materials, as well as space and cost of an inventory of new shipping materials.

Not only are the shipping materials wasted, but the existing method of non-standardized shipping carriers has provided neither optimum shipping protection of the IC devices, nor optimized weight and volume of the total transporting mechanism. As illustrated in FIG. 2, one or more stacks of trays are typically loaded into an intermediate container or skid 202. The skid has shock absorbing material such as Styrofoam inserts 204 surrounding each corner. Alternately, corrugated cardboard inserts surround the trays, and a plastic air pocket film (bubble pack) is placed on top of the package. Stacks of trays are separated by packing materials and the stacks are covered by plastic bubble pack material. One or more intermediate containers 202 are then housed in an outer shipping container 205, which may also be lined with shock absorbing materials.

Packing and shipping materials for reels may be even less reliable, and more material and labor intensive. Each reel is packaged into a single, flat cardboard box. The single boxes must be repacked into an outer container; the single boxes do not provide sufficient mechanical protection for the reel and IC devices. A problem has surfaced when the flat reel boxes have been incorrectly used as shipping containers, resulting in damage to the tape, reel and costly IC devices.

A strong need exists for a robust, shipping container system for IC devices which allows re-use of the materials, provides protection of the IC devices, and provides efficient handling for the users.

SUMMARY

It is an object of this invention to provide a multifunctional system for storing, and shipping packaged integrated circuits, including the step of first providing a container, as well as methods for use of the container. The invention will provide a means for eliminating excessive disposal of shipping materials and containers, and for minimizing expenditure of labor and material for new containers at each point of work.

It is further an object of the invention to provide a multifunctional shipping container system which is applicable for transporting integrated circuits carried in either trays or in tape and reel format.

Another object of the current invention is to provide a container sufficiently robust to protect the IC devices, and the primary carriers from damage due to mechanical shock normally encountered during shipping.

Another object of the invention is to provide a shipping container which allows ready access to the contents for loading, unloading or inspection.

Another object of the current invention is to provide a shipping container which is both lighter in weight and volume than conventional shipping methods.

A further object of the invention is to provide an open container or in-house "tote" for ready access to the primary IC carriers at work stations, or for moving from one work station to another within the same work site.

The multiple use container of the current invention consists of a base unit with two fixed side-walls and two side-walls which may be expanded for ready access to the closely spaced contents, a full walled, telescoping lid, a pair of foam inserts for mechanical stability, and interlocking handles.

The method of re-using the container for integrated circuit device transport has the following flow; the container is filled with trays or reels at the manufacturer of those products, and is shipped to the integrated circuit assembly site. The trays or other primary carriers are removed, filled with IC devices and returned to the container; the container is sent to the next work site, which could be a site for electrically testing the devices, a distribution site, or an end use customer. Following the work step at each location, or series of locations, the user sends the container to the next using location and after the final work step, the container is returned to a re-processing center for inspection, and returned directly to the integrated circuit assembly site.

The environmentally friendly, multiple use container system minimizes the need for labor and materials associated with disposal of shipping materials, and the cost of new shipping materials at each subsequent work station in the flow of packaged integrated circuits. It provides a more light weight, compact, and robust shipping assemblage, as compared to conventional techniques.

BRIEF DESCRIPTION OF THE DRAWINGS

FIG. 3 illustrates the components of the current invention.

DETAILED DESCRIPTION OF THE INVENTION

The preferred embodiment of the present invention includes a multifunctional, robust system for shipping integrated circuit devices which are housed in primary carriers housed either in tray or in tape and reel format. The system includes a protective container, and methods for repeated use of the container.

The container illustrated in FIG. 3 includes a base unit 301 of corrugated material, such as cardboard, a pair of shock absorbing inserts 307, a full telescoping lid 310, and a pair of interlocking, flanged handles 322. When the side-walls are in fully closed position, all side-walls are essentially perpendicular to the bottom of the base to form an inner cavity. The flanged handles serve to lock the base, lid and inserts.

Figure 4:
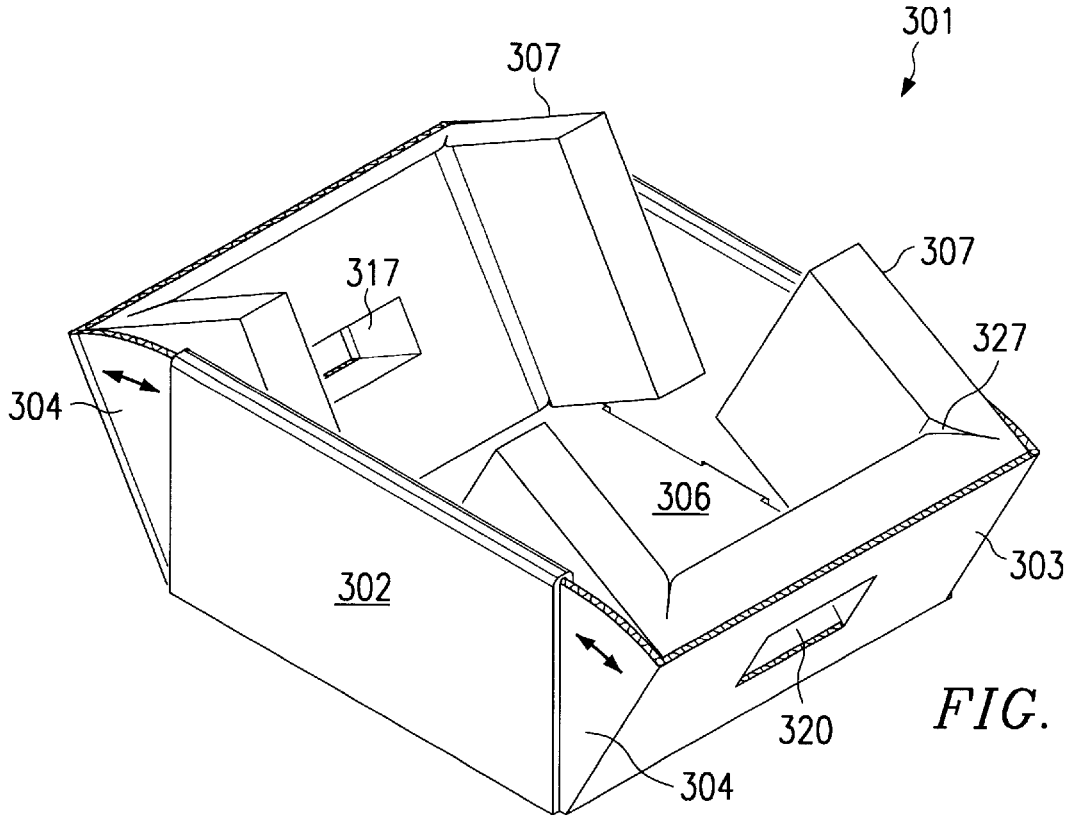
FIG. 4 provides a perspective view of an expanded multifunctional shipping container base unit and foam inserts.

In a second embodiment of the container, the base is expanded as shown in FIG. 4. The base unit consists of an attached pair of parallel side-walls 302, perpendicular to the base bottom 306, and a second set of parallel side-walls 303 having a quarter circular 90 degree protrusion 304 on both sides of both ends. The side-walls are attached to and hinged from the container base bottom 306. The first set of side-walls 302 includes a double thickness of the corrugated material, folded inwardly at the top of the base unit to form a full channel between the folded walls, and locked into the bottom of the base unit. The quarter circular protrusions 304 on the second set of side walls 303 provide a means to move within the channel between the double walled thickness of the first set of side-walls 302, as illustrated in FIG. 4. The moveable quarter circular protrusions 304 allow the side-walls 303 to be partially opened, and to provide an expanded opening of the base unit for ease of access to the pay load, or for inspecting labels or contents.

Foam inserts 307 are positioned inside the base unit adjacent to the moveable side-walls 303, and extend about one-third of the length of the fixed side-walls 302. The inserts are form fitted to the side-walls, and may be attached to the moveable walls 303, but may not be attached to the fixed side-walls 302. Because the inserts are not attached to the fixed side-walls, they do not interfere with the expansion of the base cavity, but do move with the moveable walls. The inserts 307 preferably comprise a polyethylene foam in the range of 0.5 to 1.25 inches in thickness. The foam inserts provide mechanical protection for the integrated circuits and their primary carriers.

Figure 5:
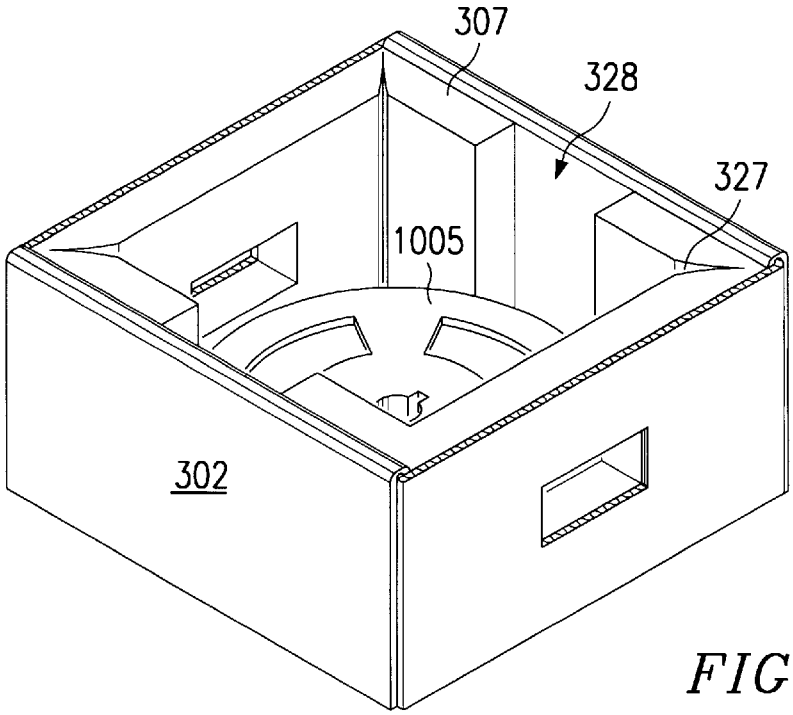
FIG. 5 illustrates a reel positioned in the multifunctional container.

Because the two inserts on the fixed wall 302 of the container extend only about two-thirds the length of the wall, an unfilled space is created. As illustrated in FIG. 5, the space 328 between foam inserts on the on the fixed set of side-walls 302 provides an area for the outer rims of the reel 1005 to fit into the open space, and the rims are held snugly by the ends of the foam inserts. The opposite sides of the reel are secured by full foam insert walls. In the case of trays, the open space 328 between the foam inserts allows for manual accessibility to the trays.

Returning now to FIG. 3, the full telescoping carrier lid 310 is of similar material composition to the base unit and has a top section 311, and two sets of parallel side-walls 312 and 313 perpendicular to the top. Dimensions of the lid top and sides are slightly larger than those of the base, and the height of the lid is approximately equal to the base depth.

Figure 6:
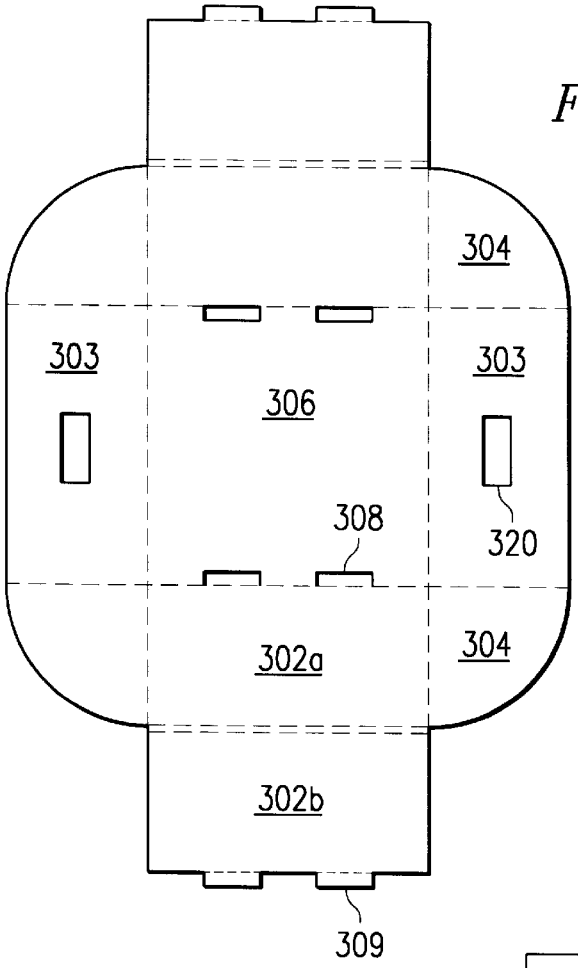
FIG. 6 provides a plan view of the multifunctional shipping container base.

In order to better understand the base design which allows the side-walls 303 to fan-out and expand the opening, a plan view of the unassembled base unit 301 is given in greater detail in FIG. 6. Side-walls 302*a* and 302*b* fold perpendicular to the base, section 302*b* folds into the base cavity and tabs 309 lock into apertures 308 on the bottom of the base. The folded side-wall forms a channel the full length and height of the side-wall 302. Side-walls 303 fold from the bottom section 306 of the base unit, along with quarter circular sections 304. The quarter circular portions 304 are positioned in the channel between the folded and locked sections 302*a* and 302*b*, and are able to slide freely between the double walled sections, thereby allowing a means for the base opening to expand longitudinally.

Figure 7:
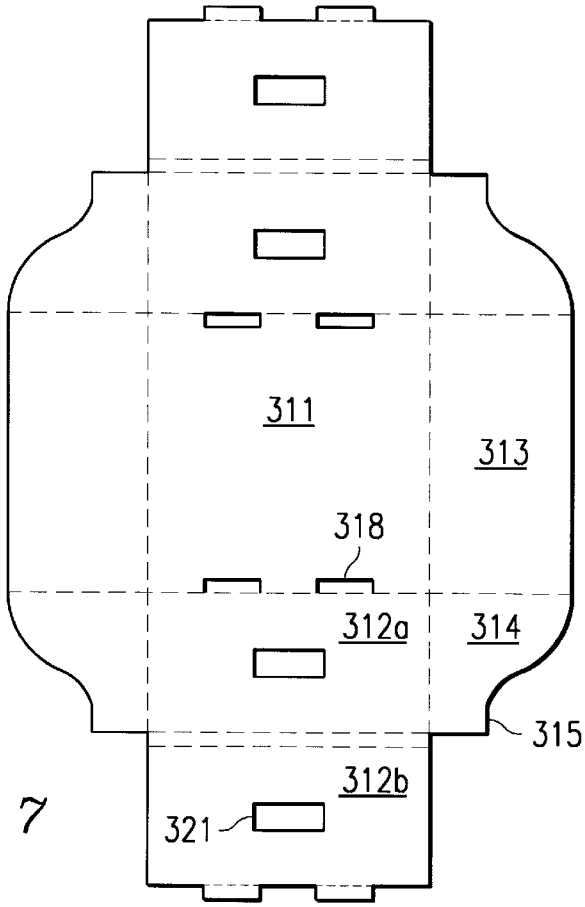
FIG. 7 provides a plan view of the lid of the shipping container lid.

A plan view of the lid in FIG. 7 shows construction similar to that of the base, except that a notch 315 is formed in the quarter circular section 314 to restrict motion by engaging with pair of interlocking, flanged handles (not shown). As with the base, side-walls 312 fold inwardly and lock into apertures in the 318 in the top to form a double thickness side-wall.

It can be seen in FIGS. 3, 4, and 6 that an aperture 320 exists in each of the moveable side-walls 303 of the base unit, in the center of the foam inserts at location 317, and in the lid at position 321. The apertures are self-aligning and provide a position for placement of an interlocking flanged handle at the ends of the container. Commercially available plastic handles secured by flanges are well suited for aligning and locking the container components without need for tape or straps, and for ease of manual movement.

Figure 8:
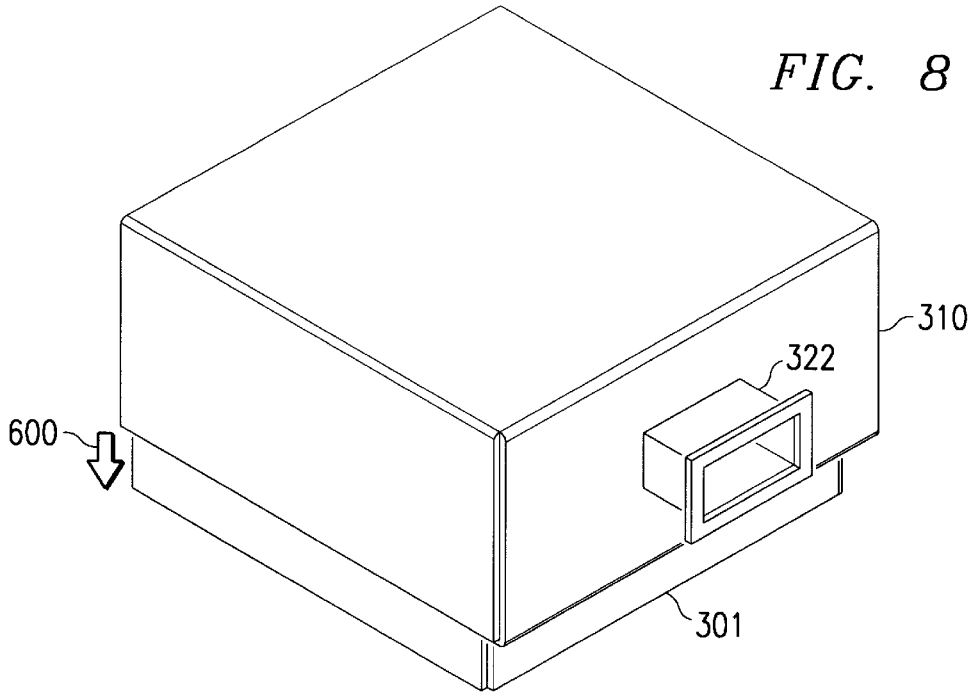
FIG. 8 demonstrates the telescoping lid of the shipping container.

In FIG. 8, the telescoping lid 310 with centered handle 322, and base 301 are demonstrated in a partially closed position, as indicated by the arrow 600. When the base 301 and the lid are fully closed, the interlocking flanged handles 322 can be inserted in apertures 321 and locked.

Figure 9:
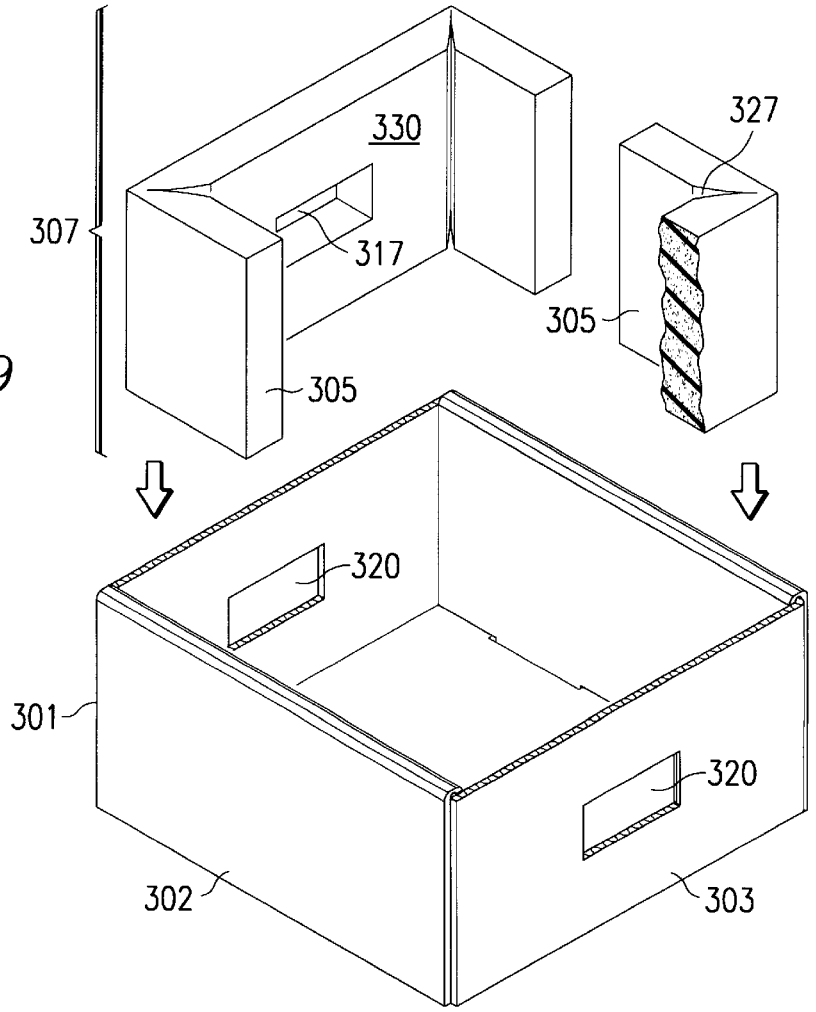
FIG. 9 illustrates the foam inserts with respect to the base.

In FIG. 9, an exploded view of foam inserts 307 is demonstrated with respect to the container base 301. The foam insert has a first side 330 extending the full width of the base unit side-wall 303, and two short sides 305 which extend approximately one-third the length of the base side-wall 302. Height of the insert 307 is approximately equal to the height of the base 301. As demonstrated by the arrows, the inserts are fitted into the base with the apertures 320 and 317 aligned for a locking handle aligned. The inserts 307, comprising preferably an anti-static polyethylene foam are in the range of 0.5 to 1.25 inches in thickness. The inserts have 45 degree beveled edges 327 at ends of each side piece forms a corner. The beveled edges allow the thick inserts to conform to the corners of the container. The dense form fitting inserts conform to the side-walls of the base unit. The insert may be affixed to the moveable side-wall 303, but may not be affixed to the fixed side-walls 302 so that the inserts can move with the moveable walls.

The container of the current invention is preferably intended for storing and shipping integrated circuits in primary carriers. Dimensions of the carriers are fixed based on existing designs and standards, and therefore dictate the size of the shipping container of the present invention. Outer dimensions of the multiple use container are preferably approximately 16.5 by 15 inches by 8 inches in height.

In the fully assembled shipping container, the double thickness of the first side-wall 302 aligns with a single thickness of the lid side-wall 313. Conversely a single thickness of the base side-wall 303 aligns with a double thickness of the lid side-wall 312 providing a triple thickness of corrugated material on each side-wall of the assembled container, and a robust shipping container.

High density foam inserts 307 coupled with tightly fitted construction of the inserts to the container and to the primary carriers provide, not only excellent mechanical shock protection, but also a light weight, compact sized shipping container fully capable of protecting the carriers and ICs while occupying the minimum amount of space.

Figure 1A:
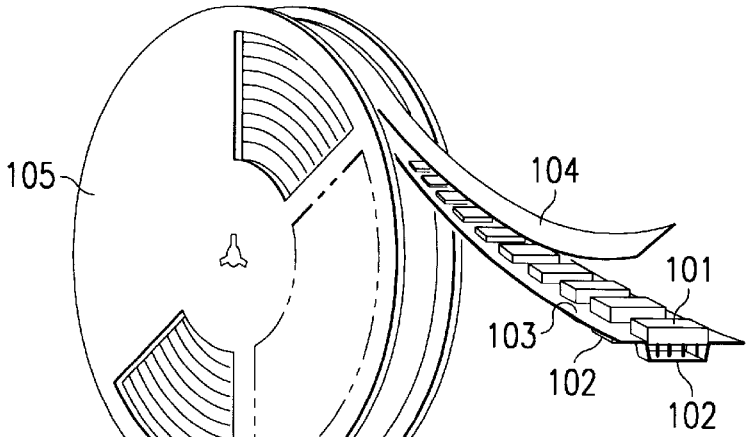
FIG. 1a (PRIOR ART)
FIG. 1*a* illustrates tape and reel carrier format for integrated circuits. (Prior art)
Figure 1B:
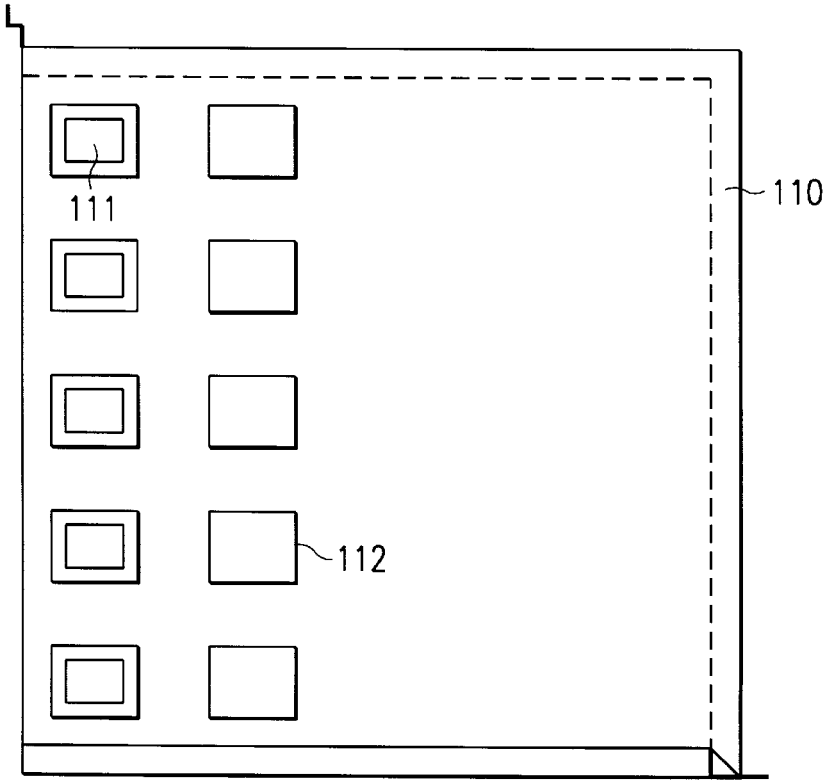
FIG. 1b (PRIOR ART)
FIG. 1*b* illustrates a tray with recesses holding integrated circuits (Prior art)
Figure 2:
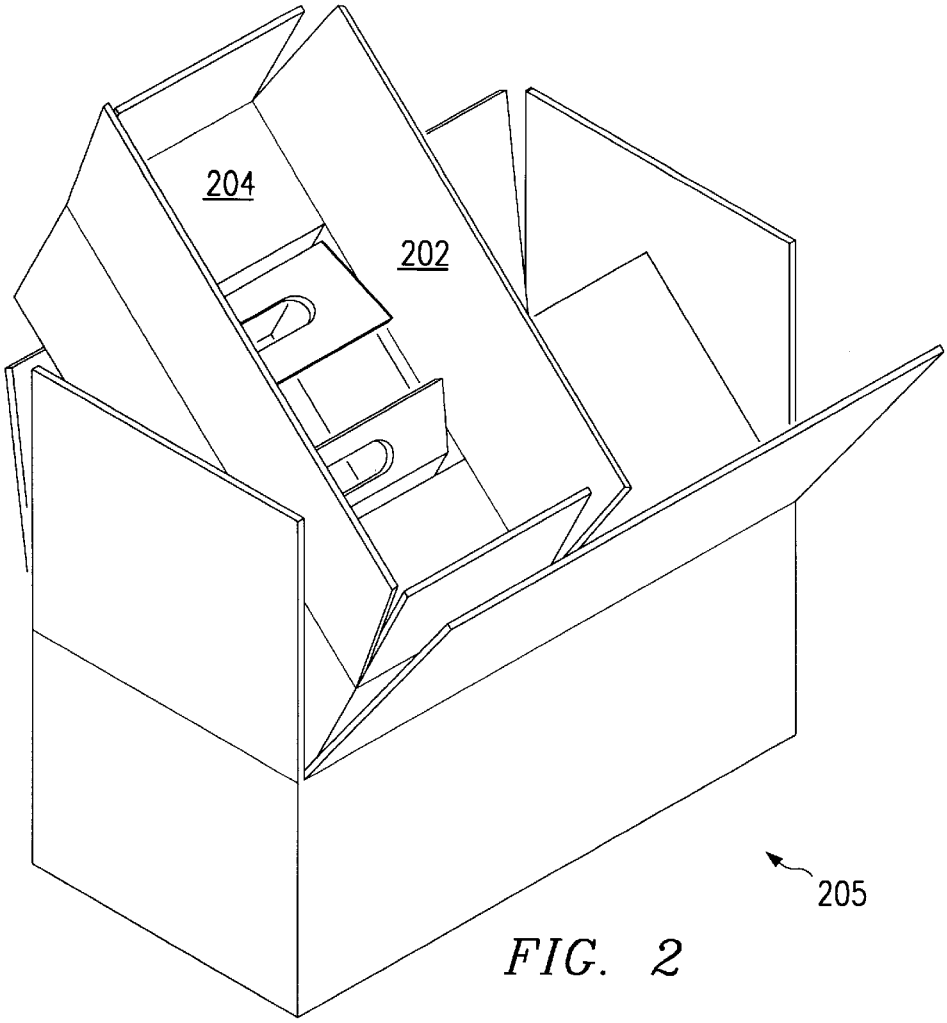
FIG. 2 illustrates a container and packing materials of existing technology.
Figure 10:
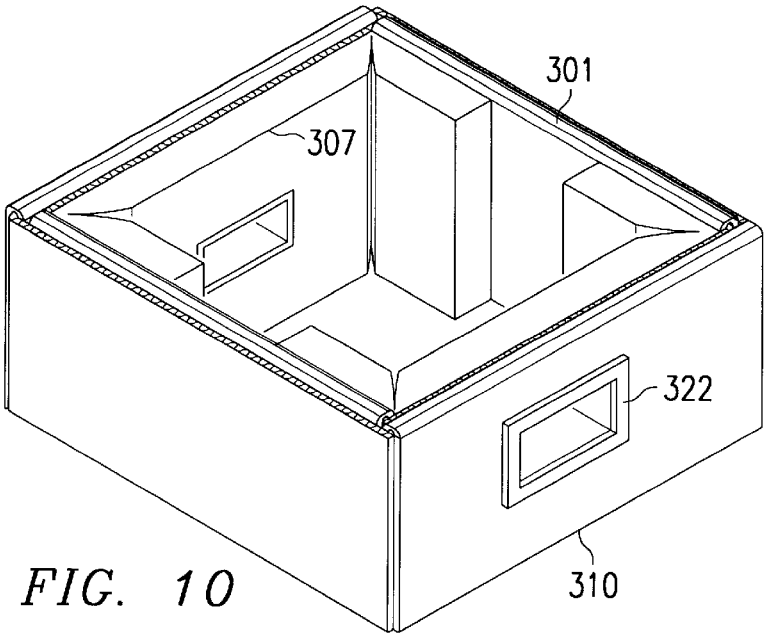
FIG. 10 provides a prospective view of the container in "tote" configuration.

In another embodiment, illustrated in FIG. 10, the full telescoping base 301 and lid 310, with aligning apertures and handles 322 further lend themselves to providing an in-house "tote" for holding primary carriers during processing at a work station, or for carrying the pay load between work stations. To convert the multiple use container to a "tote" configuration, the flanged handles are removed, the lid inverted, the base positioned inside the lid, and the handles reinstalled, thereby forming a sturdy, open container for access to the primary containers, and with handles for carrying between work stations, both at the IC manufactures sites and at the end customer work stations.

Turning now to a method for using the shipping system of the current invention. The multifunctional container lid and base of a corrugated material, such as cardboard or a lint free material, such as corrugated polyethylene are fabricated, and may be stored flat until needed. The parts are mechanically assembled, without need for tape or staples.

Historically, plastic trays with recesses, commonly used for holding surface mount integrated circuits, such as quad flat packs (QFP) and ball grid array (BGA) packaged devices are stacked together in a shipping container with shock absorbing materials for transporting from the manufacturer of the trays to the fabrication site of IC packages. These containers, shock absorbing inserts, and other packaging materials are discarded at the IC assembly site.

In the preferred embodiment of the current invention, the multifunctional integrated circuit container is assembled at the tray manufacturer as illustrated in FIGS. 3 and 8 from the flat structure as shown in FIGS. 6 and 7. Foam inserts 307 are placed in the container base to protect the trays from damage during shipping. The container is loaded with two stacks of trays, each with 25 trays at the tray manufacturer. The container loaded with trays is shipped to the IC assembly site, converted to an in-house "tote" configuration, and moved directly to the final package assembly work site, typically after trim and form of lead frames, and singulating into individual units. The container and trays loaded with integrated circuit devices, are taken either to a work station for electrical testing, or a bake work station where the devices are baked to drive off moisture. Following the dry bake process, each stack of trays with a cover tray is placed into a moisture barrier bag with desiccant and humidity indicator, evacuated and heat sealed. If the devices are not moisture sensitive, and require no bake process, they are placed into a static shielding bag and sealed. Four stacks of loaded trays, with bar code and other necessary identification are packed into the multiple use container for shipping to the next work station or site. In the life cycle of an integrated circuit the devices typically encounter the following work stations; assembly and bake, electrical testing which may be in-house or at a remote location. The tested products are shipped to a product distribution center for storage awaiting customer need. Finally, the devices are shipped to a customer site for assembly onto a circuit board. At each of these sites, the multifunctional container is either fully opened and unloaded, as is the case for testing, or at a product distribution center the expandable side-walls may be moved to allow verification of product identification. At the customer board assembly site, the handles are removed, the lid inverted, the base placed inside, and the handles replaced to form an in-house "tote" at the work station, as shown in FIG. 10.

Finally, after the integrated circuits have been removed at the customer board assembly, the empty trays are reloaded into the multifunctional container and returned to a reprocessing and inspection site.

In an alternate embodiment, the multifunctional container follows a similar process flow for integrated circuits transported in tape and reel format to the flow for tray carriers. Tape and reel format is frequently used for such IC packages as small outline integrated circuits (SOIC), chip scale packages (CSP) or other smaller devices. Again, as with the trays, the reels must arrive at the assembly site in good mechanical condition in order to function efficiently on an automated feed and load equipment. Typically, each reel is packaged in an individual container, usually a lightweight corrugated box, and a stack of the boxes are over-packed in a second container with a mechanically insulating material, such as a foam pad or bubble pack.

In the preferred embodiment for shipping integrated circuits in tape and reel format, precisely the same container as that used for shipping trays is employed. The design dimensions, coupled with the foam padding allow good mechanical support of either the previously described stack of trays, or a stack of reels, positioned as illustrated in FIG. 5. For IC device shipping and storage, reel diameter remains constant at 13 inches, and the width increases with the IC package size. The tape and reel width govern the number of reels packaged in the container; for example, approximately 6 reels of 12 mm width will fill a container, while approximately 3 reels of 56 mm width fill the same container. Table 1 provides an approximate indication of the number of reels, and the comparative tray loading for the multiple use shipping container of the current invention.

TABLE 1

Approximate Loading Volume of Shipping Container

| | Reels Reel thickness | | | | | |
|---|---|---|---|---|---|---|
| Trays | 12 mm | 16 mm | 24 mm | 32 mm | 44 mm | 56 mm |
| 40 trays + 4 cover trays | 7 | 6 | 5 | 4 | 3 | 2 |

As described previously for tray shipment, the fully assembled multifunctional container with foam inserts is assembled and filled with reels at the reel manufacturer prior to shipping to an IC assembly site. Reels are loaded and unloaded into the multifunctional container by opening the expandable side-walls, loading the reels horizontally in the container, and repositioning the side-walls. The foam inserts secure the reels on all sides of the container. Additional foam pads may be positioned under and on top of a stack of reels to secure them vertically.

At the IC assembly site, the container top is removed, the side-walls expanded for removal of the empty reels and for replacement after filling. Assembled and tested integrated circuits are placed in the tape recesses, and a cover tape applied to hold the devices in place. The reels are placed in moisture barrier or static shielding bags, sealed, and sent to the next work site, such as a product distribution center. Finally the reels are shipped to a user site for assembly onto a circuit board.

After the ICs have been removed at the customer site, the reels are placed back in the container and returned to the reprocessing and inspection site where damaged containers may be discarded, or good containers may be reconditioned for return to service at the IC package assembly site, or original reel and tray supplier.

Figure 11:
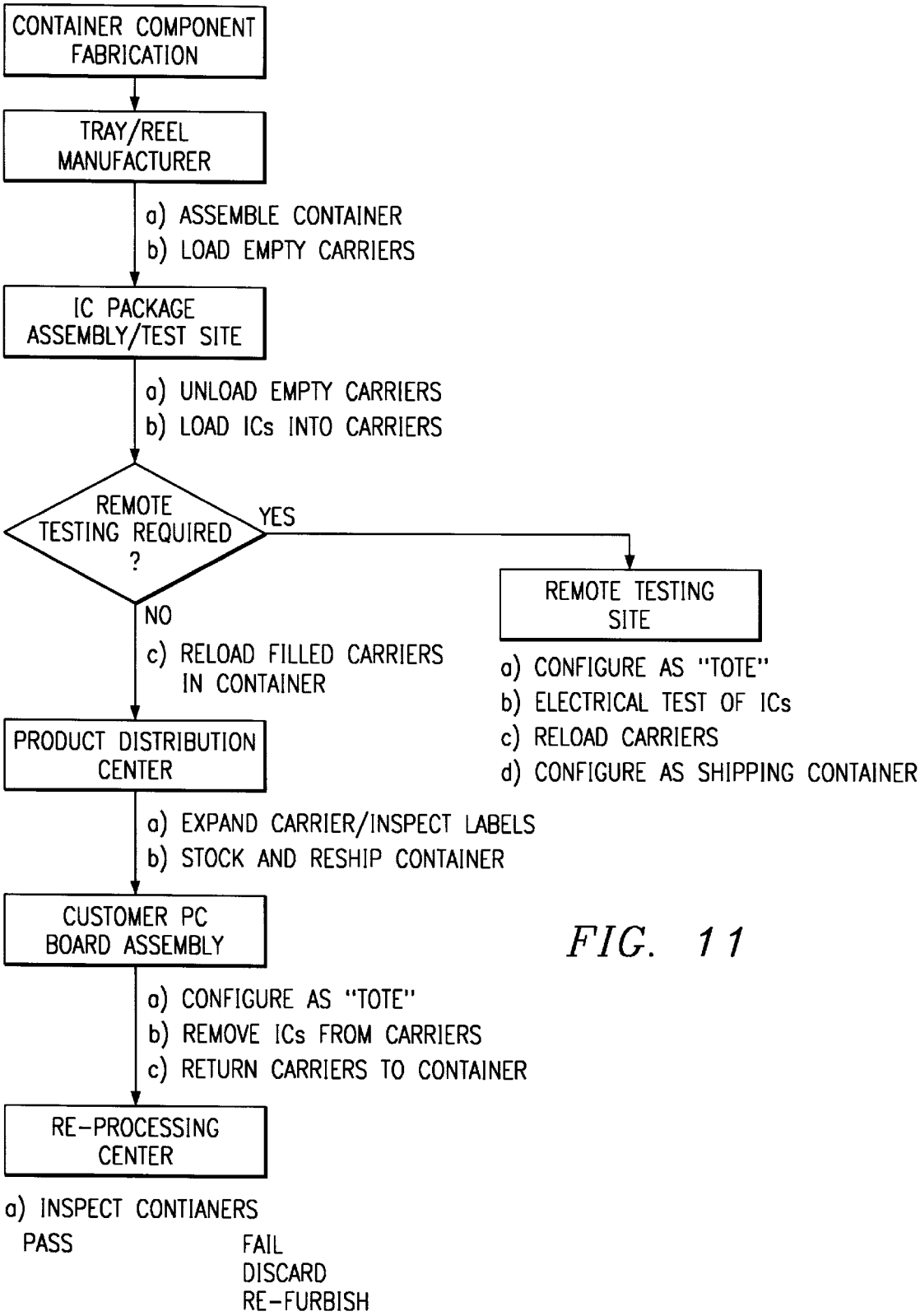
FIG. 11 provides a process flow for use of the multifunctional shipping container.

FIG. 11 provides a schematic flow chart of the system for multiple use of the multifunctional shipping container of the current invention.

The present invention provides a robust and environmentally friendly system, primarily for transporting packaged integrated circuit devices housed in either tape and reel, or in tray format. The system includes both a container, and methods of use. The shipping container with high density shock absorbing inserts provides a relatively light weight, and compact system fully capable of protecting packaged integrated circuits and their carriers. The multifunctional container is re-used at each work site in the assembly flow not only for shipping, but also as an in-house carrier or "tote". The expandable design of the container allows for ease of use, and for label inspection, while occupying a minimal amount of floor space. The reusable system provides a means to minimize disposal of shipping materials, and to minimize inventory and labor for new shipping materials at multiple stations.

The multifunctional container of the current invention has been specified at a given size, primarily for holding a pre-defined number of IC carrying trays and reels in conventional use, but the container design is not limited to that size, and will be varied as primary carriers change, or as used for alternate applications, such as transporting other fragile materials. Further, the container material of constructions have been indicated as corrugated cardboard or polyethylene, but is in no way limited to these materials, but may be any sturdy shipping material.

The invention has been described in connection with preferred embodiments, but it is not intended to limit the scope to a particular form set forth, but on the contrary, it is intended to cover alternatives, modifications and equivalents as may be included within the spirit of the invention and the scope of the invention as defined by the appended claims.

What is claimed is:

1. A method for using a shipping container assemblage for integrated circuit devices; the method comprising the steps of:

a) providing a multifunctional shipping container including shock absorbing pads, said container having dimensions to fit either IC carrier trays or reels, and a means to expand the container cavity, b) loading a plurality of empty primary carriers for integrated circuit into the base of said container, positioning a lid on the base, and shipping said container to a user site, c) removing the primary carriers from the container, and reloading the container with carriers filled with integrated circuit devices at each subsequent work station, including sites for assembly, electrical testing, distribution, and end product user production, and d) loading the empty primary carriers into said container and shipping to a re-cycle center.

2. A method as in claim 1 wherein the container is in the range of 7.7 to 8.5 inches high, and the inner dimensions of the container in the range of 16.3 to 16.75 inches by 14.7 to 15.3 inches.

3. A method as in claim 1 wherein said shock absorbing pads comprise polyethylene foam, in the range of 0.5 to 1.25 inches thickness.

4. A method for using a shipping container assemblage for integrated circuit devices; the method comprising the steps of:

a) providing a multifunctional container comprising:

a base unit having a plurality of side-walls, said side-walls extending essentially perpendicular from the bottom of the base unit to form a container having an inner cavity, a first set of the parallel said side-walls in a fixed position perpendicular to the bottom of the base, a transverse second parallel set of side-walls having a means to move and expand said cavity in the longitudinal direction, said first and second set of side-walls attached to and hinged from the bottom of the base unit, a pair of shock absorbing pads positioned inside and adjacent to the transverse side-walls, and extending partially along the length of the fixed side-walls, a lid having a plurality of side-walls, the first set of said side-walls approximately equal in length to the transverse side-walls of the base, the second set of side-walls approximately equal in length to the fixed side-walls of the base, and said side-walls extending essentially perpendicular from the top to form an inner cavity, inner dimensions of the lid being slightly larger than the outer dimensions of said base unit, a series of self-aligning openings in said transverse side-walls of the base, in the first set of side-walls of the lid, and in the shock absorbing pad, and a pair of interlocking, flanged handles capable of mating said openings, b) loading a plurality of empty primary carriers for integrated circuit into said container base having shock absorbing pads, positioning the lid on the base, affixing the handles and shipping to a user site, c) removing the primary carriers from the container, and reloading the container with carriers filled with integrated circuit devices at each subsequent work station, including assembly, test, distribution centers, and end product user production work sites, d) loading the empty carriers into the container and shipping to a re-cycle center.

5. A method as in claim 4 wherein the dimensions of said multifunctional container, coupled with the dimensions of said shock absorbing pads provide a secure fit for transporting either carrier trays or reels for integrated circuits.

6. A method as in claim 4 further including the steps of expanding the base unit by pushing the transverse side-walls outwardly from the cavity.

7. A method as in claim 4 wherein an quarter circular protrusion extends from each side of the second set of side-walls on the base.

8. A method as in claim 4 wherein the first set of side-walls of the base is double thickness having a channel between the folds.

9. A method as in claim 4 wherein said base and said lid comprise corrugated cardboard in the range of 0.020 to 0.035 inches thickness.

10. A method as in claim 4 wherein the container is assembled by mechanical locking means only.

11. A method as in claim 4 wherein said first set of side-walls is locked by tabs which fit into apertures in the bottom of said base unit.

12. A method as in claim 4 wherein the container is in the range of 7.7 to 8.5 inches high, and the inner dimensions of the container in the range of 16.3 to 16.75 inches by 14.7 to 15.3 inches.

13. A method as in claim 4 wherein said shock absorbing pads comprise polyethylene foam, in the range of 0.5 to 1.25 inches thickness.

14. A multiple use transport container comprising:

a base unit having a plurality of side-walls, said side-walls extending essentially perpendicular from the bottom of the base unit to form a container having an inner cavity, one parallel set of said side-walls in a fixed position perpendicular to the bottom of the base, a transverse second parallel set of side-walls having a means to move and expand said cavity in the longitudinal direction, said first and second set of side-walls attached to and hinged from the bottom of the base unit, a pair of shock absorbing pads positioned inside and adjacent to the transverse side-walls, and extending partially along the length of the fixed side-walls, a lid having a plurality of side-walls, the first set of said side-walls approximately equal in length to the transverse side-walls of the base, the second set of side-walls approximately equal in length to the fixed side-walls of the base, and said side-walls extending essentially perpendicular from the top to form an inner cavity, said lid inner dimensions slightly larger than the outer dimensions of said base, a series of self-aligning openings in said transverse side-walls of the base, the first set of side-walls in the lid, and in the shock absorbing pads, and a pair of interlocking, flanged handle capable of mating said openings.

15. A container as in claim 14 wherein a quarter circular protrusion extends from each side of the second set of side-walls on the base unit.

16. A container as in claim 14 wherein the first set of side-walls in the base unit is double thickness having a channel between the folds.

17. A container as in claim 14 wherein said cavity is expandable longitudinally.

18. A container as in claim 14 wherein the height of the lid is approximately equal to the depth of the base.

19. A container as in claim 14 wherein each of the four side-walls of said container configured for shipping comprise a triple thickness of corrugated material.

* * * * *